United States Patent [19]

Dempster

[11] 3,933,300

[45] Jan. 20, 1976

[54] LOIN BOX WITH LOCKING COVER

[75] Inventor: Thomas B. Dempster, Sioux City, Iowa

[73] Assignee: Hoerner Waldorf Corporation, St. Paul, Minn.

[22] Filed: Jan. 20, 1975

[21] Appl. No.: 542,194

[52] U.S. Cl. ..... 229/33; 229/34 R; 229/36; 229/44 R

[51] Int. Cl.[2] ..... B65D 5/22

[58] Field of Search ..... 229/34 R, 33, 36, 44 R, 229/31 FS

[56] References Cited

UNITED STATES PATENTS

| | | | |
|---|---|---|---|
| 3,162,350 | 12/1964 | Miller | 229/31 FS |
| 3,203,613 | 8/1965 | Stowe | 229/33 |
| 3,801,000 | 4/1974 | Hurley et al. | 229/44 R |

FOREIGN PATENTS OR APPLICATIONS

| | | | |
|---|---|---|---|
| 1,357,126 | 2/1964 | France | 229/36 |

*Primary Examiner*—William Price
*Assistant Examiner*—Stephen P. Garbe
*Attorney, Agent, or Firm*—Jerry F. Best

[57] ABSTRACT

A loin box is provided which can be set up without the use of tools. The rear wall is provided with end walls and bottom reinforcing panels, as well as an end wall reinforcing panel. The front wall is provided with end walls which are sandwiched between the outer end wall and the end wall reinforcing panel. The top panel is provided with a front flange having extensions which fold outwardly of the end walls. The box is held closed by locking flaps on the ends of the top panel which extend through hand holes in the end walls.

5 Claims, 6 Drawing Figures

LOIN BOX WITH LOCKING COVER

This invention relates to an improvement in loin box with locking cover, and deals particularly with a container designed to contain loins or other such products.

BACKGROUND OF THE INVENTION

Numerous containers have been produced of corrugated or fiber to take the place of wood wire-bound boxes previously used. Some of these containers have open tops while others have covers of one type or another. The present invention resides in the provision of a covered container with a novel means of holding the container locked in set-up form.

SUMMARY OF THE INVENTION

The present invention relies on the provision of a container formed of corrugated paperboard or the like which is suitably coated to prevent moisture from penetrating into the paperboard. In its preferred form, the container includes a bottom wall, front and rear walls, and a top panel hinged to the upper edge of the rear wall. A front flange is hinged to the forward edge of the top panel which is designed to fold down forwardly of the upper portion of the front wall. End wall flanges are hingedly connected to the ends of the front wall and these end wall flanges are designed to extend outwardly of the upper portions of the end walls above the hand holes formed in the end walls. A locking means is connected to each end of the top panel, and each locking means is designed to lie outwardly of the end wall flange and to lock into the corresponding hand hole. By locking the top panel closed, the entire container is held in its assembled form.

In the specific arrangement shown in the drawings, the rear wall is hingedly connected along its ends to outer end wall panels. These end wall panels are hingedly connected along their lower edges to bottom reinforcing panels which overlie the bottom panel. The outer end walls are connected at their upper edges to top flanges which extend outwardly parallel to the bottom panel. End wall reinforcing panels are hinged to the inner edges of the top flanges, and extend downwardly and outwardly to lock with the bottom wall reinforcing panels. Thus the end wall structures are generally triangular in section, providing high stacking strengths so that the boxes may be stacked one upon the other.

A further feature of the present invention lies in the particular manner in which the locking flaps on the top panel operate. The intermediate end walls which are hinged to the ends of the front panel are provided with flaps hingedly connected to the remainder of the panels along their lower edges. These flaps are folded inwardly by the insertion of the locking flap, and the ends of the locking flap are arranged to engage against the portion of the intermediate end walls to form an effective lock which cannot readily be unlocked once the locking flaps are in place.

These and other objects and novel features in the present invention will be more clearly and fully set forth in the following specification and claims.

DESCRIPTION OF THE PREFERRED EMBODIMENT

Figure 6:
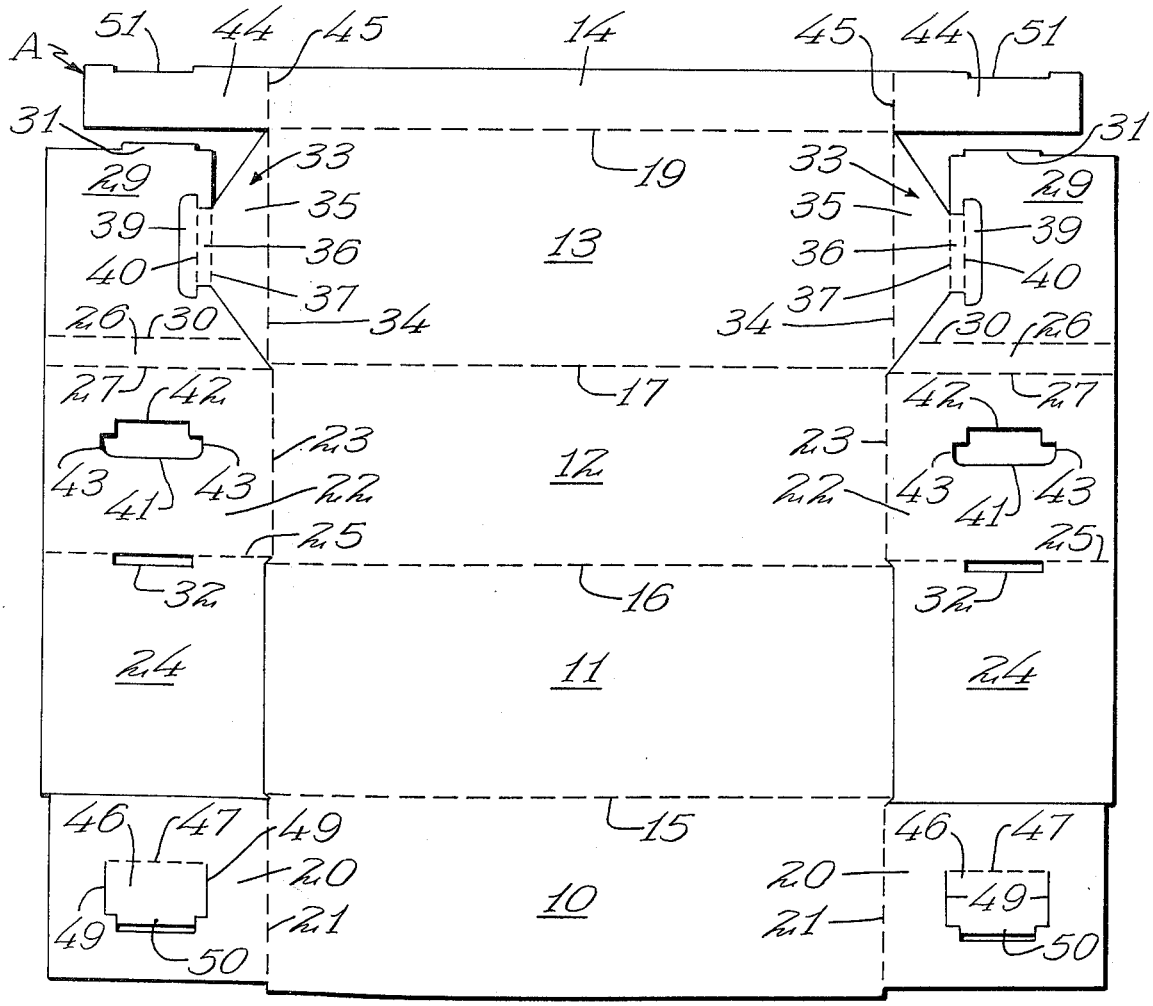
FIG. 6 is a diagrammatic view of the blank from which the container is formed.

The container A, as shown in blank form in FIG. 6 of the drawings, includes a front panel 10, a bottom panel 11, a rear wall panel 12, a top or cover panel 13 and a front flange 14 connected in series along parallel fold lines 15, 16, 17 and 19. Intermediate end walls 20 are connected to the ends of the front wall 10 along parallel fold lines 21 which are in right angular relation to the previous fold lines described. Outer end walls 22 are provided which are hingedly connected to the rear wall panel 12 along fold lines 23 which are substantially aligned with the fold lines 21. Bottom wall reinforcing panels 24 are connected to the lower edges of the end walls 22 along fold lines 25.

Top flanges 26 are foldably connected to the upper edges of the outer end walls 22 along fold lines 27. End wall reinforcing panels 29 are hingedly connected to the inner edges of the top flanges or top panels 26 along fold lines 30. Locking tongues 31 project from the lower edges of the end wall reinforcing panels 29 and are designed to extend into locking slots 32 in the bottom panel reinforcing panel 24 adjoining the fold lines 25 connecting these bottom reinforcing panels to the outer end walls. Locking flap structures indicated in general by the numeral 33 are hingedly connected to the ends of the top or cover panel 13 along fold lines 34. These locking flap structures 33 extend into the end wall reinforcing panels 29, restricting the width of these panels 29. The locking flap structures include tapered trapezoidal portions 35, the longer parallel edges of which are hinged to the top panel, intermediate portions hingedly connected to the shorter sides of the trapezoidal portions 35 along fold lines 37, and end locking portions 39 connected to the rectangular intermediate portions 36 along fold lines 40. As will be noted, the ends of the locking portions 39 extend somewhat beyond the ends of the intermediate portions 36.

The outer end walls 22 are provided with hand holes 41 which are shaped very similarly to the combined outline of the intermediate portions 36 and locking portions 39 of the locking flap structures 33. The upper edges 42 of the hand holes 41 are spaced from the fold lines 27 a distance substantially equal to the length of the trapezoidal portions 35 of the locking flap structures 33. In other words, the portion of the hand holes joining the upper edges 42 are of a width substantially equal to the length of the intermediate portions 36 of the flap structures 33, and the lower portions of the hand holes are somewhat wider as indicated at 43. As a result, when the locking flap structures 33 are folded downwardly outwardly of the end walls 22, the lower portions of the flap structures 33 may be folded inwardly to extend through the hand holes 41. As is also indicated, end wall flanges are hingedly connected to the ends of the front flange 14 along parallel fold lines 45 which are substantially aligned with the fold lines 34. The flanges 44 are designed to fold outwardly of the end walls 22 when the container is closed, as will be later described.

Flaps 46 are cut from the intermediate end walls 20 and are hingedly connected thereto along fold lines 47. The cut lines 49 forming the parallel edges of the flaps 46 are spaced apart a distance substantially equal to the length of the locking portion 39 of the flap structures 33 so that the locking ends 39 of the flap structures may extend between the cut lines 49 in the closing of the container. Each flap 46 is provided at its end with a projecting portion 50 which is of a width substantially equal to the length of the intermediate portions 36 of the flap structures 33.

Figure 1:
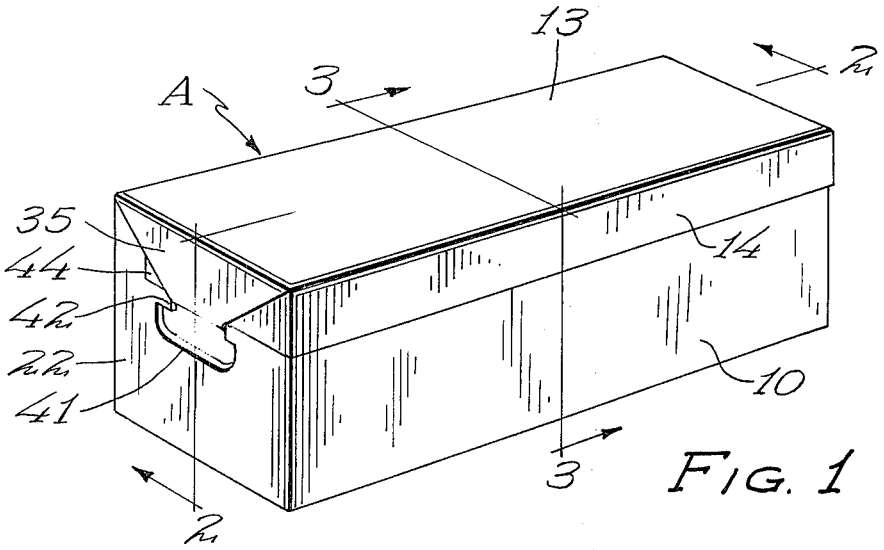
FIG. 1 is a perspective view of the container in closed position.
Figure 2:
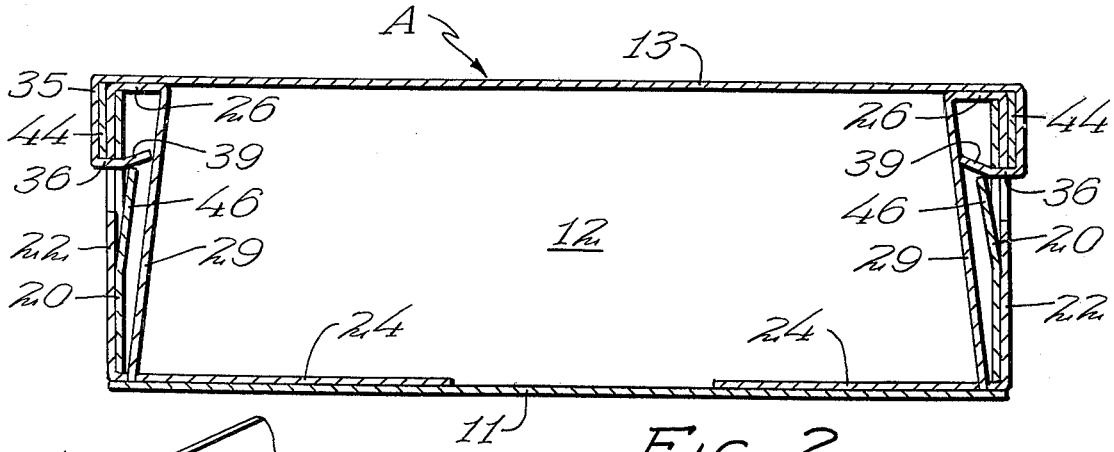
FIG. 2 is a vertical sectional view longitudinally of the container, the position of the section being indicated by the line 2—2 of FIG. 1.
Figure 4:
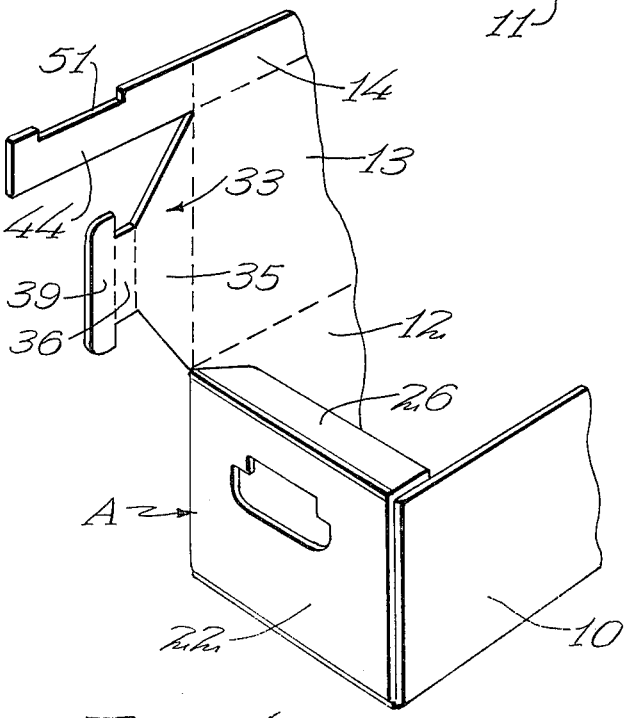
FIG. 4 is a perspective view of the container before the top or cover panel has been closed.
Figure 3:
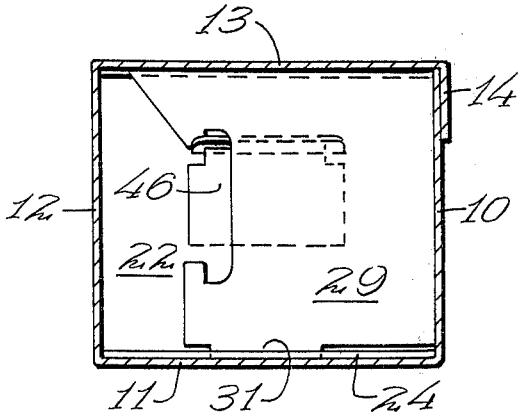
FIG. 3 is a vertical sectional view taken transversely through the container, the position of the section being indicated by the line 3—3 of FIG. 1.
Figure 5:
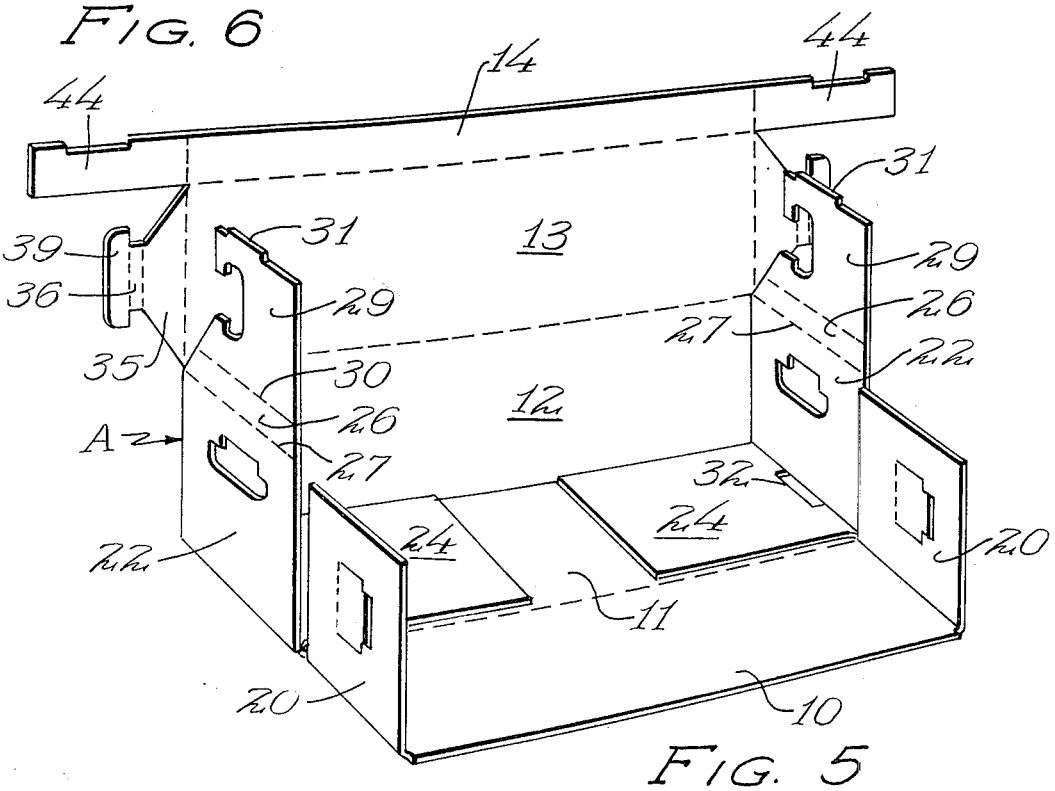
FIG. 5 is a perspective view of the container in partially closed position showing the arrangement of the parts therein.

The formation of the container is started as indicated in FIG. 5 of the drawings. The rear wall 12 is folded upwardly into vertical position from the rear edge of the bottom panel 11. The end walls 22 are folded into right angular relation to the rear wall 12 to extend forwardly therefrom. During this operation, the bottom reinforcing panels 29 are folded to overlie the ends of the bottom panel 11 as indicated in FIG. 5. The intermediate end walls 20 are folded upwardly from the ends of the front panel 10, and the front panel 10 is then swung upwardly, the panels 20 lying inwardly of the outer end wall panels 22. The assembly is completed by folding the top flanges or panels 26 being folded downwardly into coplanar relation along the fold lines 27, and the end wall reinforcing panels 29 being folded downwardly and outwardly, along the fold lines 30, until the tongues 31 engage in the slots 32. The top flanges or panels 26 act as a reinforcement for the top panel 13 when the cover is closed, the outer end walls 22, the top flanges 26, and the end wall reinforcing panels 29 forming a generally triangular strut at each end of the container. This is best indicated in FIG. 2 of the drawings.

After the container A has been filled, the container is closed by folding the top or cover panel 13 downwardly to rest against the top flanges 26. The front flange 14 is folded downwardly to lie outwardly of the front wall 10, and the end flanges 44 are folded to lie outwardly of the upper portion of the outer end walls 22. As indicated, the lower edges of the flanges 44 may be notched as indicated at 51, the notches registering with the upper portion of the hand holes 41. The locking flap structures are then folded down outwardly of the flanges 44, the trapezoidal portions 35 extending outwardly of the end flanges 44. The portions 36 and 39 are then folded inwardly through the hand holes 41 and against the flaps 46 in the intermediate end walls 20. As indicated in FIG. 2 of the drawings, the flaps 46 hold the locking portions 39 upwardly, the locking portions 39 engaging the inner surfaces of the intermediate panels 20 to hold the cover securely locked. In other words, in order to disengage the locking portions 39 so that the cover may be opened, it is necessary to fold the flaps 46 inwardly sufficiently so that the portions 36 and 39 of the flap structures 33 may pass through the wider portions 43 of the hand holes 41.

With this arrangement, an effective loin box is produced which may be effectively closed, and which may be readily carried. The box has higher stacking strength than most such boxes due to the triangular struts at each end of the box.

In accordance with the Patent Statutes, I have described the principles of construction and operation of my improvement in LOIN BOX WITH LOCKING COVER; and while I have endeavored to set forth the best embodiment thereof, I desire to have it understood that obvious changes may be made within the scope of the following claims without departing from the spirit of my invention.

I claim:

1. A loin box comprising:

a bottom panel, a rear wall having end walls hingedly connected to each end and extending at right angles thereto, bottom reinforcing panels foldably connected to the lower ends of said end walls and overlying said bottom panel, end wall reinforcing panels secured to the upper edges of said end walls, each of said end wall reinforcing panels having die-cut therein an area adjacent said rear wall including a vertically oriented elongated opening spaced a predetermined distance from said rear wall, a front wall having intermediate end wall panels connected to the ends thereof folded between said end walls and said end wall reinforcing panels, said end walls having hand holes therein spaced from the upper ends thereof, a top panel hingedly connected to the upper edge of said rear wall, a front flange connected to the forward edge of said top panel and overlying the upper portion of said front wall, end flanges connected to the ends of said front flange and lying outwardly of the upper portions of said end walls above said hand holes, and locking flaps on the ends of said top panel formed in shape substantially equal to said die-cut area in said end wall reinforcing panels and engageable in said hand holes to lock the top panel closed.

2. The structure of claim 1 and including flaps in said intermediate end walls inwardly of said hand holes.

3. The structure of claim 2 and in which said flaps in said intermediate end walls are hingedly connected at their lower edges, and fold inwardly when said locking flaps are inserted in said hand holes to urge said locking flaps upwardly.

4. The structure of claim 1 and including top flanges between said end walls and said end wall reinforcing panels and connecting the upper edges thereof.

5. The structure of claim 1 and including locking slots in said bottom reinforcing panels adjacent said end walls, and locking tongues on said end wall reinforcing panels engageable in said locking slots.

* * * * *